US006343883B1

(12) United States Patent
Tada et al.

(10) Patent No.: US 6,343,883 B1
(45) Date of Patent: Feb. 5, 2002

(54) TONER CARTRIDGE COMPRISING A MAGNET ASSEMBLY

(75) Inventors: Toshio Tada; Hideyuki Kondo, both of Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 09/492,159

(22) Filed: Jan. 27, 2000

(30) Foreign Application Priority Data

Jan. 29, 1999 (JP) ..... 11-021608

(51) Int. Cl.[7] ..... B41J 32/00

(52) U.S. Cl. ..... 400/196; 399/12; 399/106; 399/104; 399/262

(58) Field of Search ..... 400/196, 194, 400/245, 248.3, 249; 399/12, 104, 106, 262, 263

(56) References Cited

U.S. PATENT DOCUMENTS

| | | | | |
|---|---|---|---|---|
| 4,912,512 A | * | 3/1990 | Midorikawa et al. | 399/12 |
| 4,963,938 A | * | 10/1990 | Sonda et al. | 399/12 |
| 4,963,939 A | | 10/1990 | Kurando et al. | 355/260 |
| 5,184,181 A | | 2/1993 | Kurando et al. | 355/260 |
| 5,289,242 A | * | 2/1994 | Christensen et al. | 355/260 |
| 5,755,519 A | * | 5/1998 | Klinefelter | 400/249 |

FOREIGN PATENT DOCUMENTS

| | | | | |
|---|---|---|---|---|
| EP | 0 261 643 | | 3/1988 | |
| EP | 0478 019 A2 | | 4/1992 | |
| JP | 61-156165 | | 7/1986 | |
| JP | 4338989 | | 11/1992 | |
| JP | 6-67532 A | * | 3/1994 | 399/106 |

* cited by examiner

*Primary Examiner*—John S. Hilten
*Assistant Examiner*—Minh H. Chau
(74) *Attorney, Agent, or Firm*—Rabin & Berdo

(57) ABSTRACT

A cartridge is attached to a printer that performs a printing operation only when the cartridge is a predetermined kind of the cartridge. The cartridge includes a first predetermined number of magnet holders provided on the cartridge and a second predetermined number of magnets each of which is received in a corresponding one of the magnet holders. A maximum value of the second predetermined number is equal to the first predetermined number. A combination of the magnet holders having the magnets therein indicates the kind of the cartridge. The image forming apparatus comprises a detector section and an identifying section. The detector has magnetic sensor elements each of which detects a magnetic flux of a corresponding one of the magnets. The identifying section compares reference data with a combination of outputs of the magnetic sensor elements so as to identify the kind of the cartridge.

14 Claims, 14 Drawing Sheets

| | M1 | M2 | M3 | M4 |
|---|---|---|---|---|
| 1 | ● | ○ | ● | ○ |
| 2 | ○ | ○ | ○ | ○ |
| 3 | ● | ○ | ○ | ○ |
| 4 | ○ | ● | ○ | ○ |
| 5 | ○ | ○ | ● | ○ |
| 6 | ○ | ○ | ○ | ● |
| 7 | ● | ● | ○ | ○ |
| 8 | ● | ○ | ○ | ● |
| 9 | ○ | ● | ● | ○ |
| 10 | ○ | ● | ○ | ● |
| 11 | ○ | ○ | ● | ● |
| 12 | ● | ● | ● | ○ |
| 13 | ● | ● | ○ | ● |
| 14 | ● | ○ | ● | ● |
| 15 | ○ | ● | ● | ● |
| 16 | ● | ● | ● | ● |

● : MAGNET IS PRESENT

○ : MAGNET IS ABSENT

TONER CARTRIDGE COMPRISING A MAGNET ASSEMBLY

BACKGROUND OF THE INVENTION

1. Field of the Invention

The present invention relates to cartridges such as toner cartridges, image drum cartridges, ink ribbon cartridges, and ink cartridges for use in printers, facsimile machines, and copying machines. The present invention also relates to a method of manufacturing these cartridges, and further to an image forming apparatus into which the above-described cartridges are attached.

2. Description of the Related Art

Conventional cartridges of the same construction and appearance have projections or cut-away portions different in shape from cartridge to cartridge, so that a cartridge can be identified from many other cartridges of the same appearance. The cartridge may have an area to which a seal is attached, so that users can identify the content in the cartridge.

However, the manufacture of cartridges having a portion of different shapes necessitates slightly different molds from cartridge to cartridge. This is uneconomical and an obstacle to the mass production of cartridges.

With the cartridge having a seal attached thereto, the user may inadvertently load an inappropriate cartridge into the printer. The use of an inappropriate cartridge causes poor image quality and trouble of machine operation.

SUMMARY OF THE INVENTION

The present invention was made in view of the aforementioned drawbacks and an object of the invention is to provide a cartridge where an image forming apparatus can detect the content of a cartridge when the cartridge is loaded therein.

In order to achieve the aforementioned object, the cartridge according to the present invention has a combination of magnets by which the content of the cartridge can be identified.

A cartridge is attached to an image forming apparatus that performs a printing operation only when the cartridge is a predetermined kind of the cartridge. The cartridge comprises a first predetermined number of magnet holders provided on the cartridge and a second predetermined number of magnets each of which is received in a corresponding one of the magnet holders. A maximum value of the second predetermined number is equal to the first predetermined number. A combination of the magnet holders having the magnets therein indicates the kind of the cartridge.

The image forming apparatus comprises a detector section and an identifying section. The detector has magnetic sensor elements each of which detects a magnetic flux of a corresponding one of the magnets. The identifying section compares reference data with a combination of outputs of the magnetic sensor elements so as to identify the kind of the cartridge.

Another image forming apparatus uses the aforementioned cartridge and a second cartridge attached thereto. The second cartridge includes a first detector that has first magnetic sensor elements, each of the first magnetic sensor elements detecting a magnetic flux of a corresponding one of the magnets of the first cartridge. The first cartridge includes a first predetermined number of magnet holders and a second predetermined number of magnets received in the magnet holders. A maximum value of the second predetermined number is equal to the first predetermined number. A combination of the magnet holders having the magnets received therein indicating a kind of the cartridge.

The image forming apparatus comprises a second detector and an identifying section. The second detector has second magnetic sensor elements, each of the magnets of the second magnetic sensor elements detecting a magnetic flux of a corresponding one of the magnets of the first cartridge. The identifying section determines contents of the first and second cartridges on the basis of outputs of the first and second magnetic sensor elements.

A method is used for manufacturing a cartridge having magnet holders that hold magnets attached thereto. The method comprising attaching at least one magnetic element into a corresponding one of the magnet holders formed of a non-magnetic material, the magnetic element not having been magnetized yet; and placing the cartridge in a magnetic field to magnetize the magnetic element.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

The present invention will be described in detail with reference to the accompanying drawings.

First Embodiment

<Construction>

Figure 1:
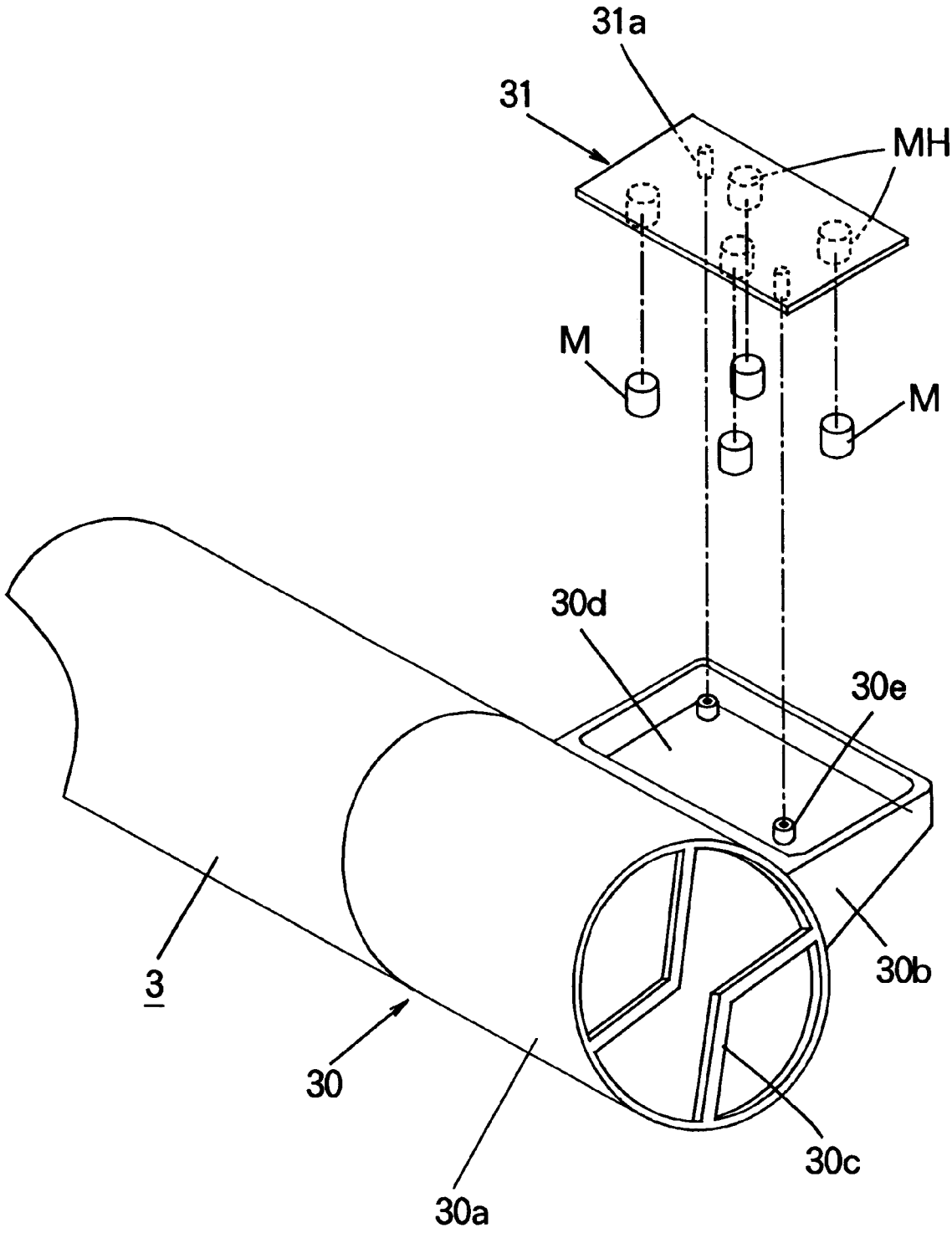
FIG. 1 is an exploded partial perspective view of a toner cartridge according to a first embodiment.

FIG. 1 is a fragmentary exploded perspective view of a toner cartridge 3 according to a first embodiment. Referring to FIG. 1, the toner cartridge 3 includes a main body, rotary cap 30, magnet assembly 31, and magnets M1–M4. The main body holds toner therein.

The rotary cap 30 includes a cylinder 30*a* and a lever 30*b* radially projecting from the cylinder 30*a*, and is rotatably fitted over one end of the main body of the toner cartridge 3. The cylinder 30*a* has a stopper 30*c* formed at an axial end of the cylinder 30*a*. The lever 30*b* is formed with a recess 30*d* in which the magnets M1–M4 are accommodated.

The magnet assembly 31 has magnet holders MH1–MH4 formed therein into which the magnets M1–M4 are firmly fitted. The magnet assembly 31 is securely assembled to the bottom surface of the recess 30*d* of the lever 30*b*. The lid 2 has, for example, four magnet holders MH1–MH4, so that different toner cartridges having different toners can be identified by different arrangements of magnets M1–M4. A predetermined number of magnets are mounted into corresponding magnet holders. FIG. 1 shows, by way of example, all of four magnets fitted into corresponding magnet holders.

The materials of the lever 30, magnet assembly 31, and magnets M1–M4 will be described. The rotary cap 30 and magnet assembly 31 are made of a non-magnetic material such as polystyrene. The magnets M1–M4 are permanent magnets made of a magnetic material. The magnetic material is classified into two main groups; ferrite materials and metal magnetic materials. Ferrite material includes barium (Ba) ferrite and strontium (Sr) ferrite. The metal magnetic material includes Alnico and rare-earth magnetic materials. The rare earth magnetic materials include samarium-cobalt (SmCo) and neodymium-iron-boron (NdFeB). NdFeB is used in the present invention, i.e., the magnets M1–M4 are in the form of magnetized NdFeB.

Figure 2B:
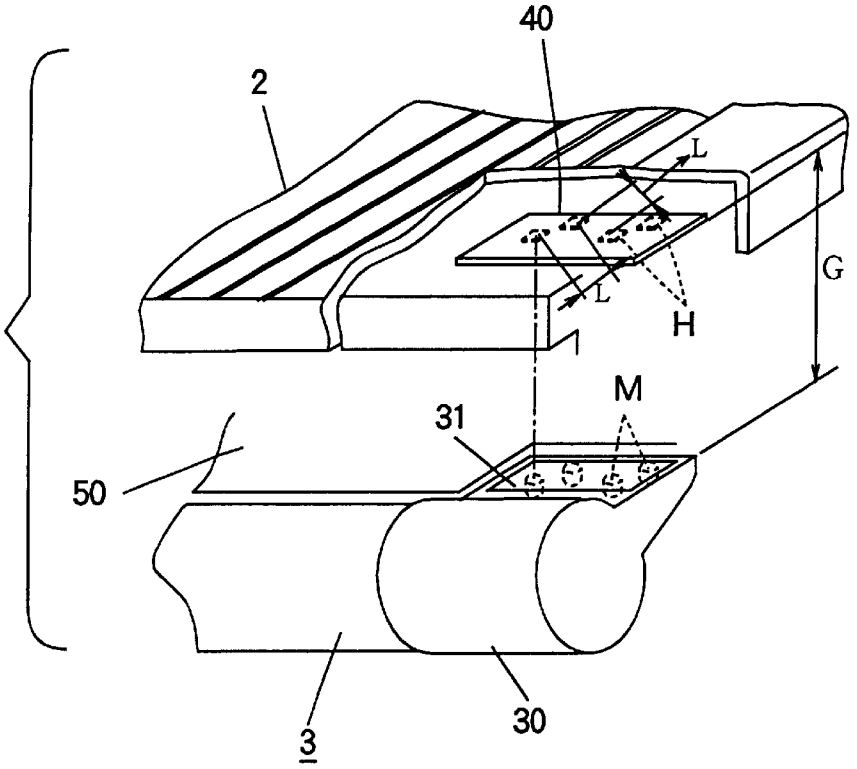
FIGS. 2–2B are perspective views of a printer according to the first embodiment.
Figure 2A:
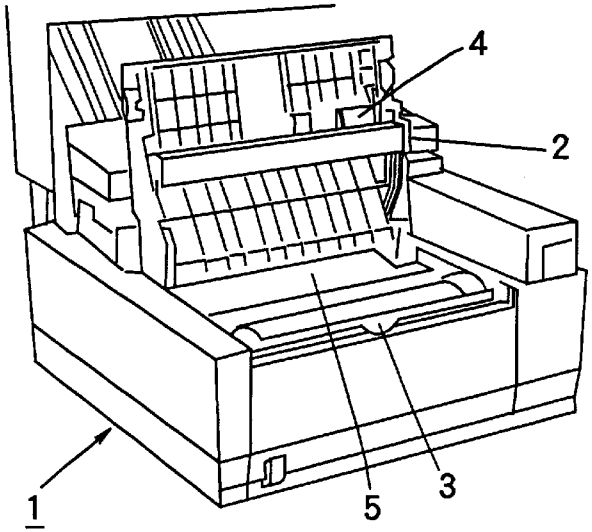
FIG. 2C illustrates the distance between adjacent Hall effect elements H1–H4.

FIGS. 2A–2B are perspective views of a printer according to the first embodiment.

Figure 2C:
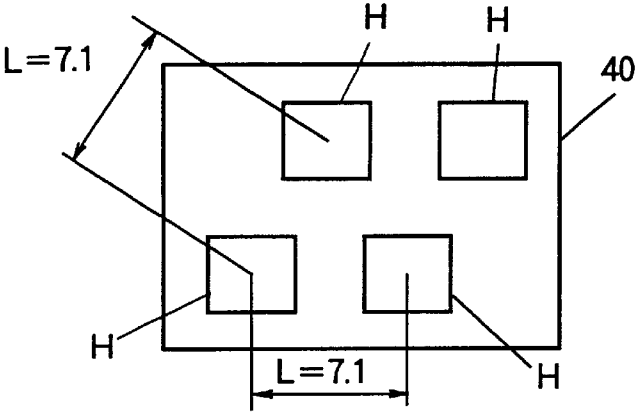

FIG. 2C illustrates the distance between adjacent Hall effect elements H1–H4.

Referring to FIGS. 2A and 2B, the toner cartridge 3 and ID cartridge 5 are loaded in the printer 1. The toner cartridge 3 has magnets M1–M4 mounted thereto. The toner cartridge 3 and ID cartridge 5 are consumable items that are replaced periodically. The printer 1 has a lid 2 to which a Hall effect element assembly 4 is mounted. The Hall effect element assembly 4 has Hall effect elements H1–H4 that detect the magnetic fluxes of the corresponding magnets M1–M4. The content of the toner cartridge 3 is identified in terms of the ON and OFF states of the Hall effect elements H1–H4.

When the magnet assembly 31 is assembled into the recess 30*d* of the lever 30*b*, the magnets accommodated in the magnet holders are sandwiched between the magnet assembly 31 and the bottom of the recess 30*d*.

Figure 3:
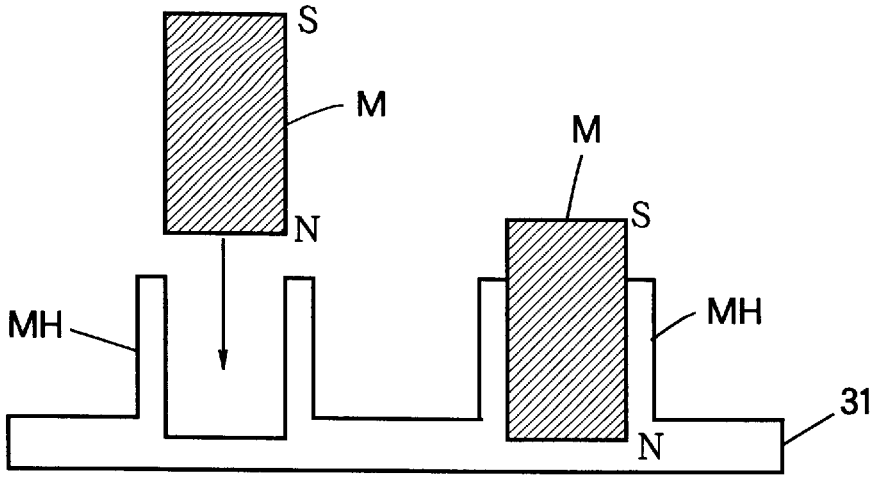
FIG. 3 illustrates mounting magnets to the magnet assembly 31 when the toner cartridge is assembled.

FIG. 3 illustrates mounting magnets to the magnet assembly 31 when the toner cartridge is assembled.

The steps at which the magnets M1–M4 are mounted to the magnet assembly 31 will be described.

As shown in FIG. 3, the magnets M1–M4 are fitted into the magnet holders MH1–MH4 of the magnet assembly 31 such that the N-poles of the magnets M1–M4 are in intimate contact with the bottom of the magnet holders MH1–MH4. Thus, the magnets M1–M4 will not drop from the magnet assembly 31 even if the magnet assembly 31 is flipped over.

The procedure of fitting the magnet assembly 31 into the recess 30*d* will be described with reference to FIG. 1.

The magnet assembly 31 is first held and oriented such that the magnet holders MH1–MH4 directly face the recess 30*d*. Then, the magnet assembly 31 is fitted into the recess with projections 31*a* fitting into corresponding receiving portions 30*e*. Upon fitting the magnet assembly 31 into the recess 30*d*, the S-poles (FIG. 3) are brought into contact with the bottom surface of the recess 30*d*. In this manner, the magnets M1–M4 are accurately placed in position.

Figure 5:
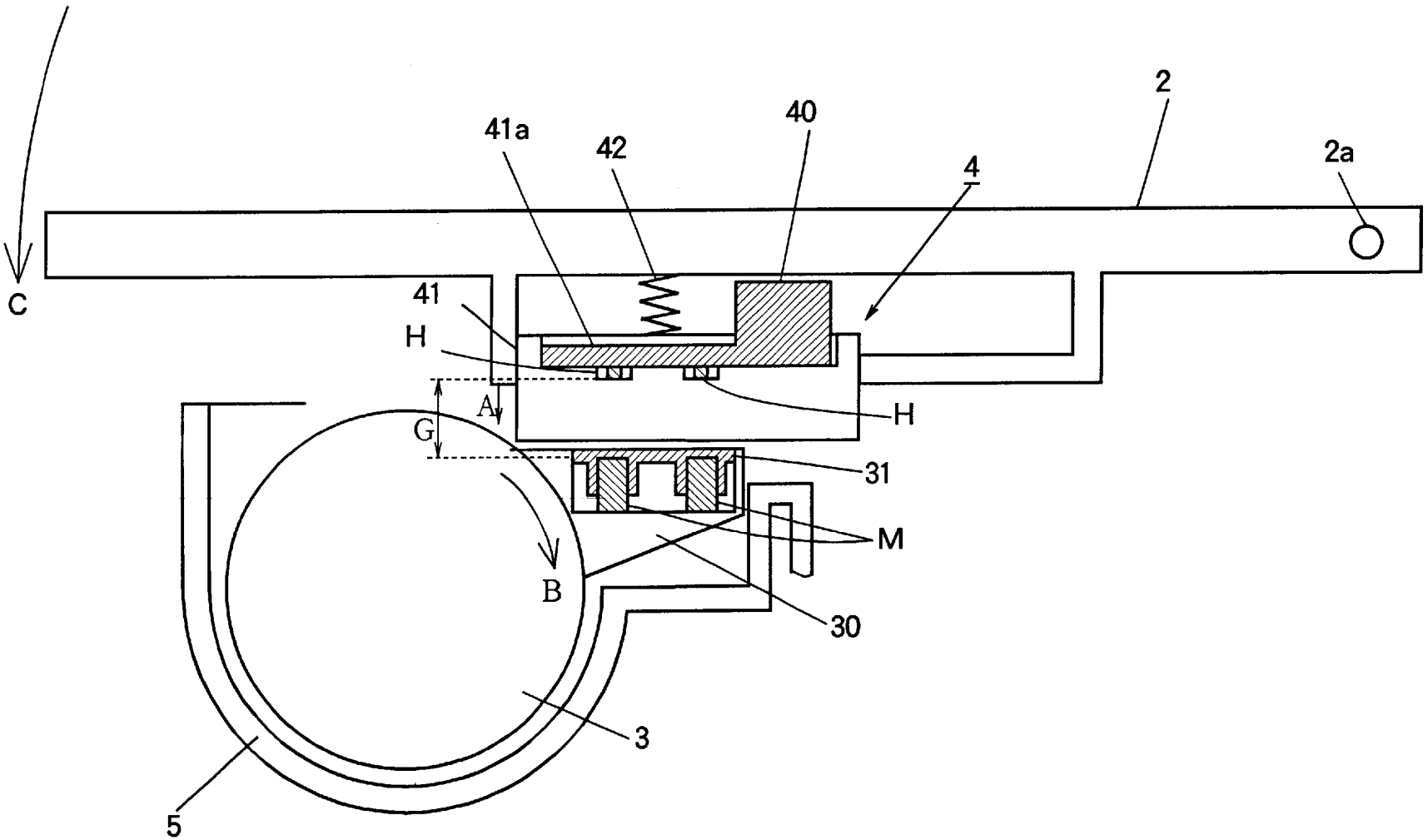
FIG. 5 is a partial cross-sectional view of the printer when the lid has been closed after the toner cartridge and ID cartridge are attached the printer.

As shown in FIGS. 2A–2C and 5, the Hall effect element assembly 4 includes the Hall effect elements H1–H4, a circuit board 40, board holder 41, and spring 42. As shown in FIG. 5, a recess 41*a* formed in the board holder 41 receives the circuit board 40 therein. A side of the circuit board 40 on which the Hall effect elements are mounted faces the board holder 41. The board holder 41 is suspended from the lid 2 by the spring 42.

The circuit board 40 has four holders in which corresponding Hall effect elements H1–H4 are accommodated. The Hall effect elements H1–H4 are received in corresponding holders formed on the circuit board 40 such that when the lid 2 is closed completely, the Hall effect elements are in alignment with corresponding magnets M1–M4 on the toner cartridge side.

Each Hall effect element Hi (i=1, 2, 3, 4) faces a corresponding magnet Mi (i=1, 2, 3, 4) with a gap G=2.6 mm between the magnet Mi and the Hall effect element Hi. The center-to-center distance L between adjacent Hall effect elements H1–H4 is 7.1 mm and the center-to-center distance L between adjacent magnets M1–M4 is 7.1 mm accordingly. The diameter of the magnets M1–M4 is 3 mm and the end-to-end distance between adjacent magnets M1–M4 is 4.1 mm accordingly.

The Hall effect element Hi detects the magnetic flux of a corresponding magnet Mi to become ON when the lid 2 is closed, and does not detect the magnetic flux of the magnet Mi to become OFF when the lid 2 is opened. For example, if the magnet Mi is absent, then a corresponding Hall effect element Hi does not become ON. When the Hall effect element Hi becomes ON, the voltage output of the Hall effect element Hi exceeds a predetermined reference value. When the Hall effect element Hi becomes OFF, the voltage output decreases below the predetermined reference value.

Figure 4:
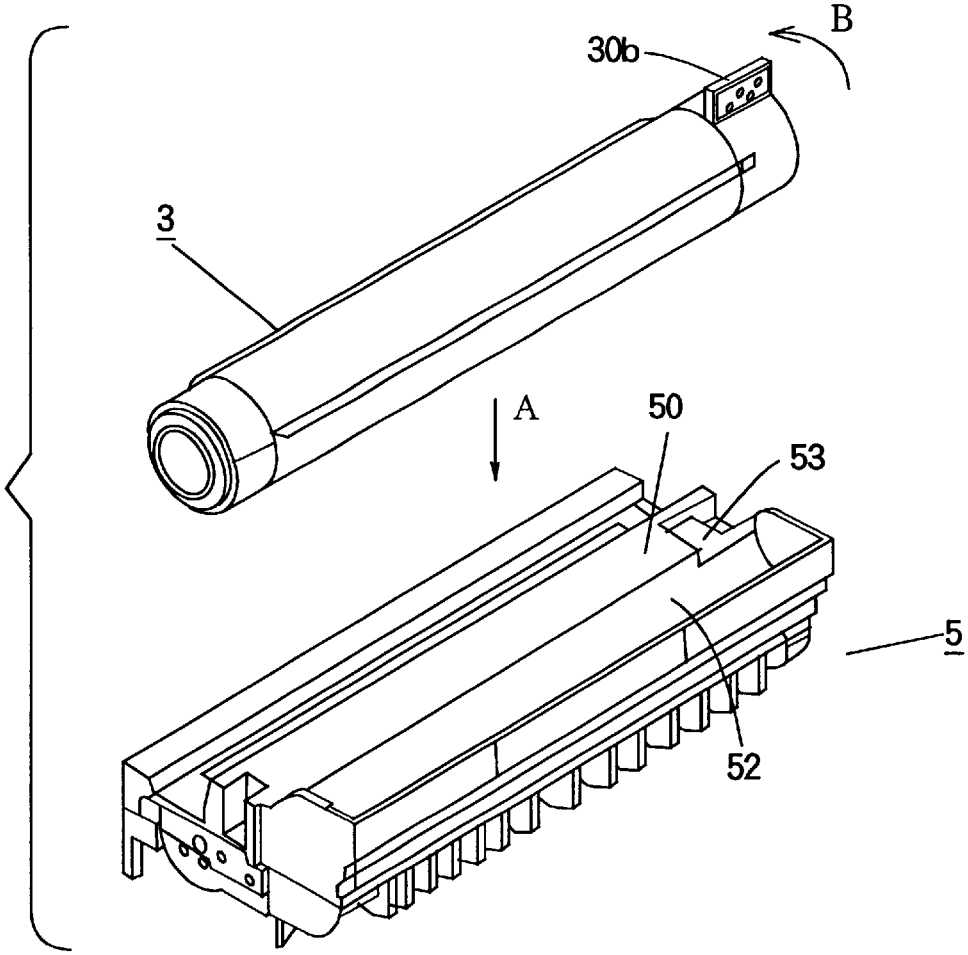
FIG. 4 is a perspective view illustrating when the toner cartridge is attached to an image drum cartridge of the printer of FIG. 2.

The ID cartridge 5 is a cartridge having an image drum (ID). Light illuminates the surface of the image drum to form an electrostatic latent image thereon. The electrostatic latent image is then developed with toner and is subsequently transferred to a print medium. As shown in FIG. 4, the ID cartridge 5 includes a toner cartridge receiving section 52 and a lever receiving section 53. The toner cartridge receiving section 52 receives the toner cartridge 3 therein. The lever receiving section 53 receives the lever 30*b* of the rotary cap 30 of the toner cartridge 3. The toner cartridge receiving section 52 extends in a direction parallel to the longitudinal direction of the ID cartridge 5. The lever receiving section 53 is located at a longitudinal end of a chassis 50.

<Attaching the toner cartridge into the printer>

FIG. 4 is a perspective view illustrating when the toner cartridge is attached to an image drum cartridge of the printer of FIG. 2.

FIG. 5 is a partial cross-sectional view of the printer when the lid has been closed after the toner cartridge and ID cartridge are attached to the printer.

The procedure for attaching the toner cartridge 3 into the printer 1 will be described with reference to FIGS. 2, 4 and 5.

The lid 2 is first opened. As shown in FIG. 4, the toner cartridge 3 is lowered in a direction shown by arrow A until the toner cartridge 3 is loaded into the toner cartridge receiving section 52 of the ID cartridge 5 which has been placed into the printer 1.

Then, the rotary cap 30 of the toner cartridge 3 is rotated in a direction shown by arrow B to a predetermined position. In other words, the lever 30*b* is rotated until the lever 30*b* is received in the lever receiving section 53 and the stopper 30*c* abuts its mating part (not shown) formed on the toner cartridge receiving section 52.

As shown in FIG. 5, when the lid 2 is rotated about a shaft 2*a* in a direction shown by arrow C, the bottom of the board holder 41 abuts the magnet assembly 31 of the lever 30*b* and the spring 42 urges the board holder 41 in the direction shown by arrow A. As a result, the lever 30*b* is further rotated slightly in the direction shown by arrow B. Therefore, even if the lever 30*b* has not been fully rotated when the user rotated the lever 30*b*, completely closing the lid 2 ensures that the toner lever 30*b* is rotated to a predetermined position.

The lid 2 is thus completely closed. This completes the mounting of the toner cartridge 3 into the ID cartridge. When the lid 2 has been completely closed, the printer 1 performs an operation for identifying the type (content) of the toner cartridge 3.

<Gaps G and distance L>

The gap G between the magnets M1–M4 and the Hall effect elements H1–H4 and the center-to-center distance L between adjacent Hall effect elements will be described.

The Hall effect element Hi should detect the magnetic flux radiated only from a corresponding magnet Mi, thereby detecting the presence and absence of the magnet Mi. Therefore, if a corresponding magnet Mi is absent, the Hall effect element Hi should not detect the magnetic flux from any other magnets. For this purpose, the size of the magnet and the center-to-center distance between adjacent magnets are carefully selected such that the Hall effect element Hi is not sensitive to the magnetic flux from any magnets that do not corresponding to the Hall effect element Hi. In the present invention, the diameter of the magnets is 3 mm and the center-to-center distance L between adjacent magnets is 7.1 mm. The center-to-center distance between adjacent Hall effect elements is 7.1.

The gap G between a magnet and a corresponding Hall effect element determines a minimum value of the distance L at which a Hall effect element is still not turned ON by a magnet not corresponding to it. If the minimum value of distance L is to be as small as possible, then the gap G should be made as small as possible. The distances L were measured for various values of G, thereby experimentally determining the minimum value of the distance L. Optimum distance L was L=7.1 mm and optimum gap G was 2.6 mm.

<Toner cartridge-identifying operation>

The toner cartridge identifying operation will be described.

Figures 6, 7:
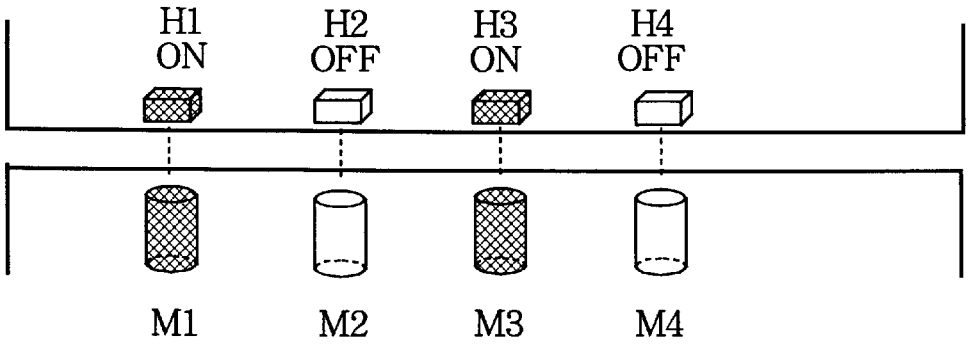
FIG. 6 illustrates the presence and absence of magnets M1–M4 and the On and OFF states of corresponding Hall effect elements, showing a when case magnets M1 and M3 are present.
FIG. 7 illustrates all possible combinations of the presence and absence of the magnets M1–M4.

FIG. 6 illustrates the presence and absence of magnets M1–M4 and the On and OFF states of corresponding Hall effect elements. FIG. 6 shows a case when magnets M1 and M3 are present.

FIG. 7 illustrates all possible combinations of the presence and absence of the magnets M1–M4.

Sixteen combinations are possible by combining the presence and absence of a total of four magnets M1–M4 in the magnet holders. Thus, a total of 16 toner cartridges 3 of the same appearance but with different contents can be expressed or identified. A toner cartridge 3 having no magnet is not manufactured.

The printer 1 stores "magnet data" indicative of the type (content) of the toner cartridge 3 that the printer 1 can accept. The magnet data describes a combination of magnets M1–M4. A plurality of items of the magnet data can be stored in the printer 1. The printer 1 determines whether a combination of the outputs of the Hall effect elements H1–H4 matches the stored magnet data, thereby identifying the content of the toner cartridge 3.

For example, as shown in FIG. 6, when a toner cartridge 3 has only magnets M1 and M3, the Hall effect elements H1 and H3 become ON and Hall effect elements H2 and H4 remain OFF. If the combination of the outputs of the Hall effect elements H1 and H3 matches with one of the items of magnet data stored in the printer 1, then the printer 1 determines that the toner cartridge 3 is an acceptable one.

If the combination of the ON and OFF states of the Hall effect elements H1 and H3 do not match the stored magnet data, then the printer 1 determines that the loaded toner cartridge 3 is not an acceptable one. Then, the printer 1 indicates to the user by way of a display or a voice message that the attached toner cartridge is not accepted, and then stops the entire operation.

Second Embodiment

A second embodiment differs from the first embodiment in that the magnets M1–M4 are mounted to the magnet assembly 31 in a different way. The rest of the construction is the same as that of the first embodiment. In the second embodiment, the magnetic elements that have not been magnetized yet are fitted into the magnet holders of the magnet assembly 31 made of a non-magnetic material, and then the entire assembly of the magnet assembly 31 is subjected to magnetization so that the magnetic elements are magnetized into the magnets M1–M4.

Figure 8A:
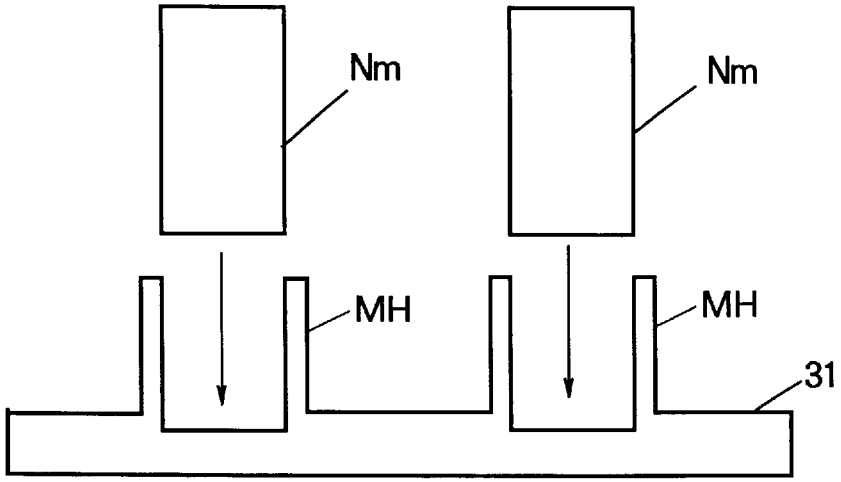
FIGS. 8A and 8B illustrate the steps for mounting the magnets M1–M4 to the magnet assembly 31.
Figure 8B:
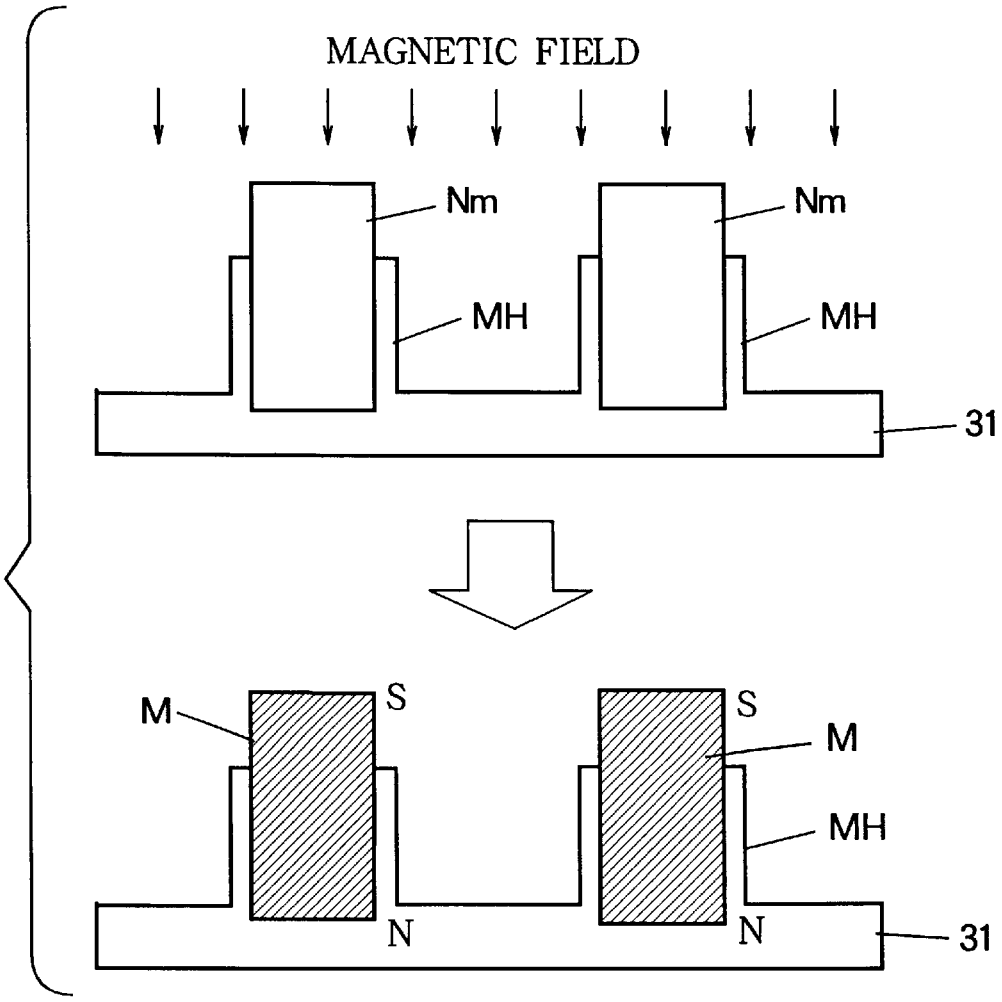

FIGS. 8A and 8B illustrate the steps for mounting the magnets M1–M4 to the magnet assembly 31.

Figure 9:
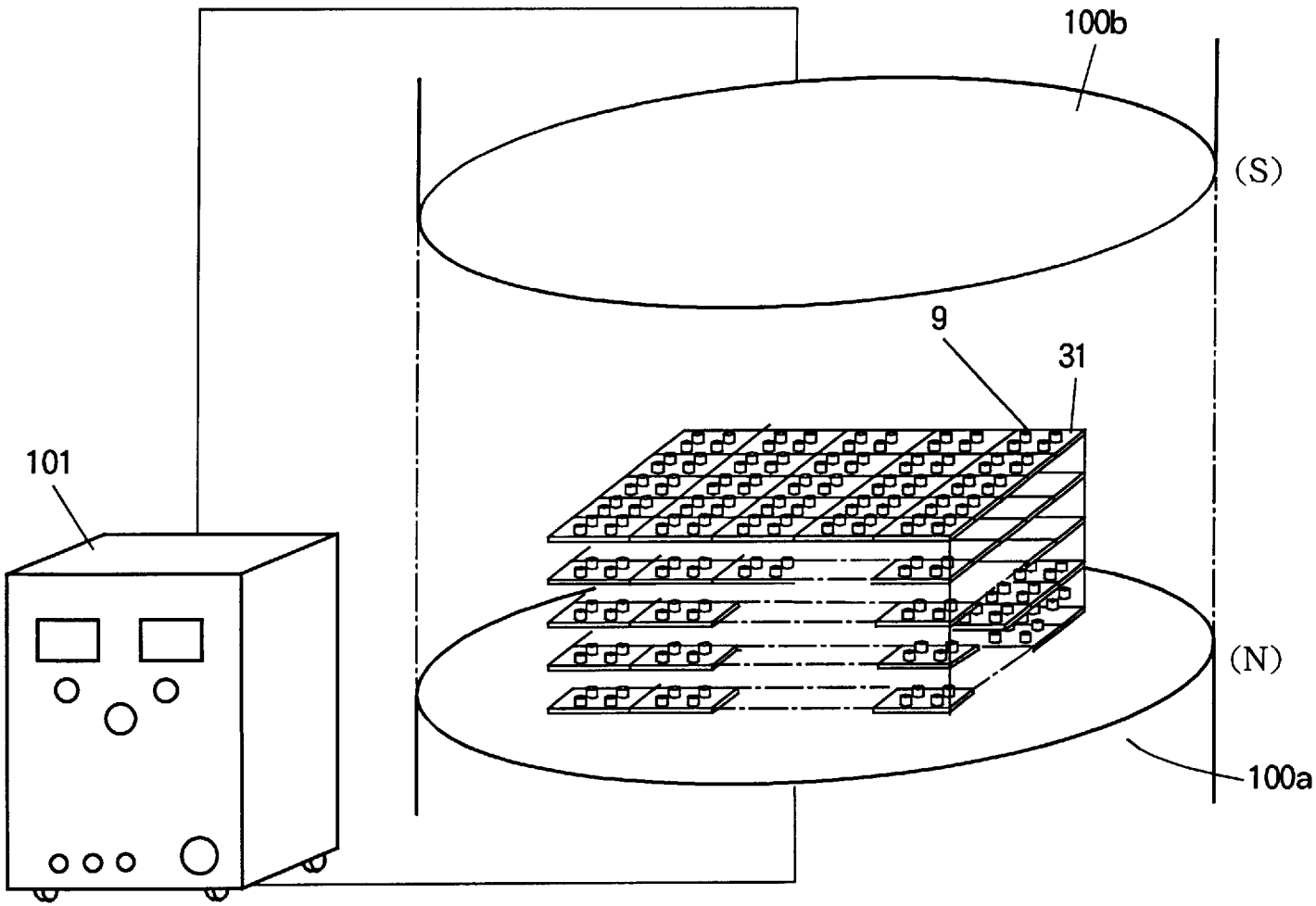
FIG. 9 illustrates the magnetizing process in which the magnetic elements Nm1–Nm4 fitted into the magnet holders of the magnet assembly 31 are magnetized.

FIG. 9 illustrates the magnetizing process in which the magnetic elements Nm1–Nm4 fitted into the magnet holders of the magnet assembly 31 are magnetized.

As shown in FIG. 8A, the magnetic elements Nm1–Nm4 which have not been magnetized yet are fitted into the magnet holders of the magnet assembly 31.

The magnet assembly 31 is placed in a magnetizing field so that the magnetic elements Nm1–Nm4 are magnetized to become magnets M1–M4. Several tens of magnet assembly 71*s* 31 having magnetic elements Nm which have not been magnetized yet are stacked on an electromagnet table 100*a*. Then, the magnetizing apparatus 101 is powered on, so that a magnetizing field is established between the electromagnet tables 100*a* and 100*b*. Thus, all of the magnetic elements Nm mounted on the several tens of magnet assemblies 31 are simultaneously magnetized to the same polarity (the ends of the magnetic elements in contact with the bottom of the magnet assemblies 31 are magnetized to N-pole).

In the first embodiment, the magnets M1–M4 are mounted to the magnet assembly 31. Thus, the magnets attract one another, making assembly operation somewhat difficult. In the second embodiment, when the magnetic elements are assembled to the magnet assembly 31, they have not been magnetized yet. This facilitates the assembly operation of the magnetic elements to the magnet assembly 31.

In the first embodiment, the magnets M1–M4 must be assembled so that their magnetic polarities are properly oriented. Thus, there is a chance of the magnets M1–M4 being mounted with improper orientations. The second embodiment not only eliminates the need for orienting the magnets M1–M4 in a specific direction but prevents the magnets M1–M4 from being mounted with wrong orientations.

Third embodiment

Figure 10B:
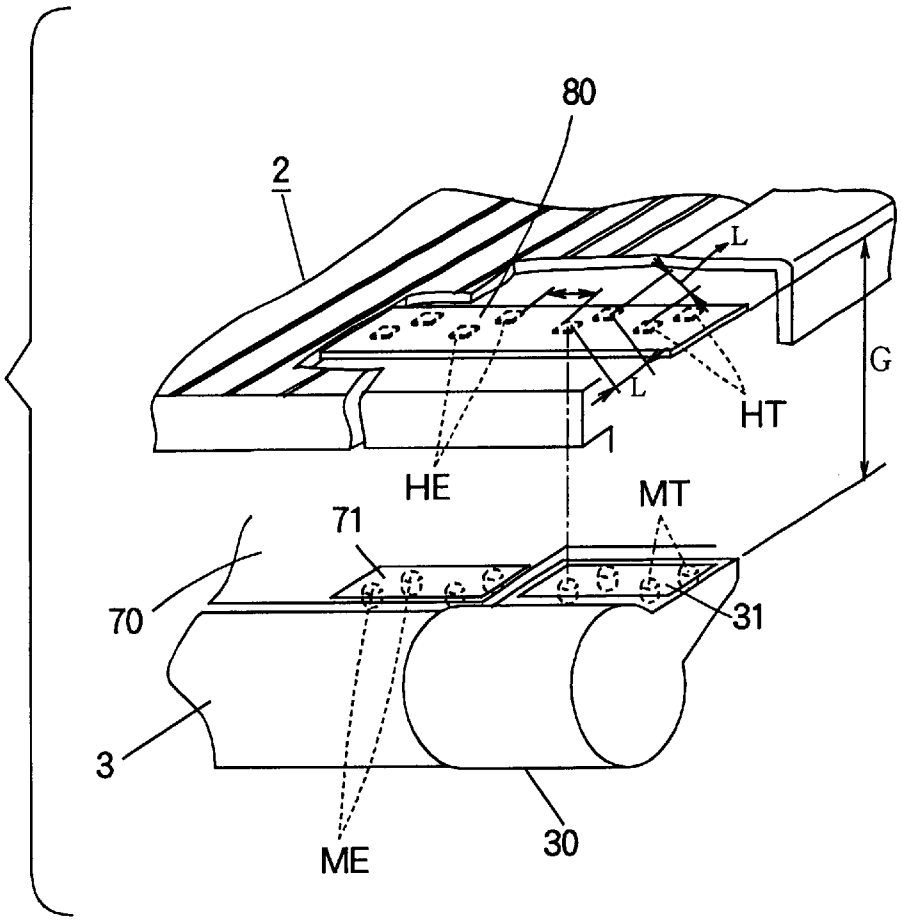
FIG. 10B is a fragmentary view of a lid 2 and the toner cartridge 3.
Figure 10A:
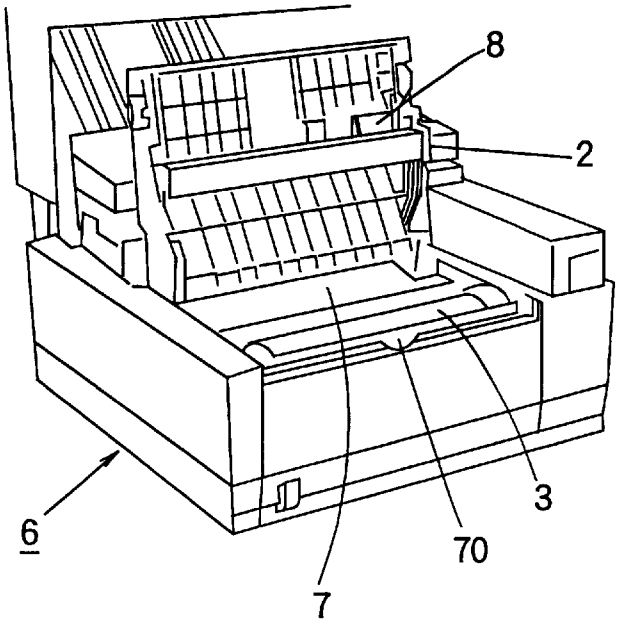
FIG. 10A is a perspective view of a printer 6 according to a third embodiment.

FIG. 10A is a perspective view of a printer 6 according to a third embodiment. FIG. 10B is a fragmentary view of a lid 2 and the toner cartridge 3.

Figure 11:
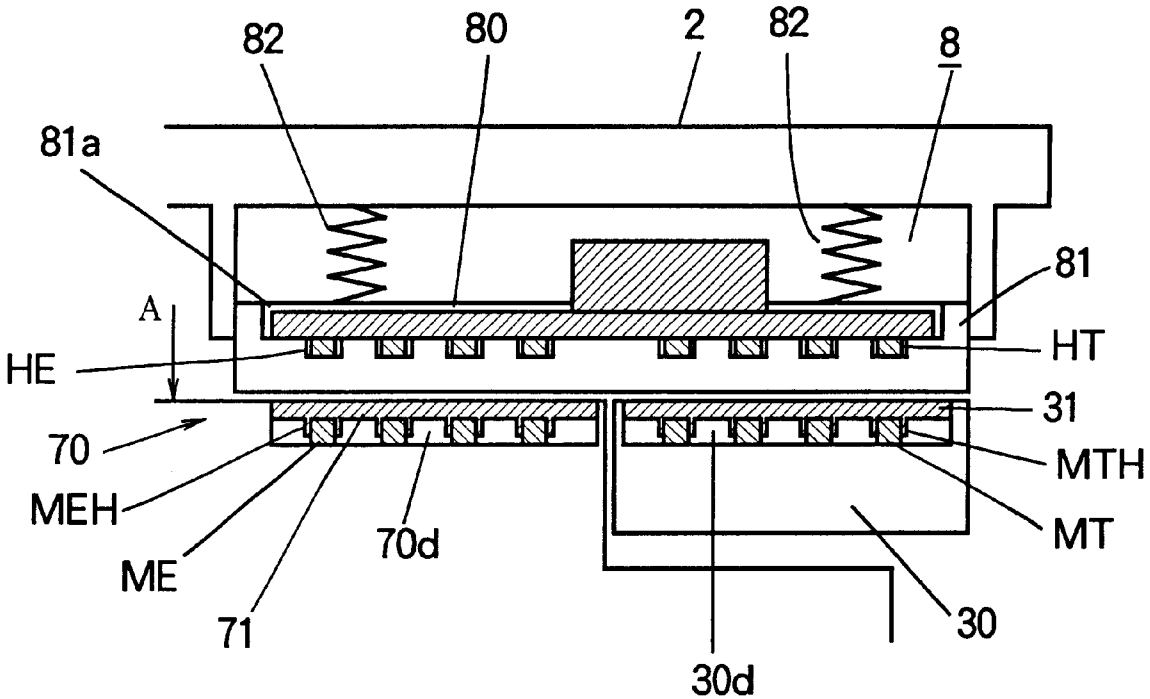
FIG. 11 is a partial cross-sectional side view of the printer 6 of FIG. 10A after the ID cartridge 7 and the toner cartridge 3 have been mounted and then the lid 2 has been closed.

FIG. 11 is a partial cross-sectional side view of the printer 6 of FIG. 10A

Elements of FIGS. 10A and 10B and FIG. 11 similar to those of the first embodiment have been given the same references.

The ID cartridge 7 and the toner cartridge 3 are loaded into the main body of the printer 6. The ID cartridge 7 has magnets ME1–ME4 and the toner cartridge 3 has magnets MT1–MT4. The magnets ME1–ME4 and MT1–MT4 are the same as the magnets M1–M4 of the first embodiment. The lid 2 of the printer 6 is provided with a Hall effect element assembly 8, which includes Hall effect elements HE1–HE4 that detect the fluxes of the magnets ME1–ME4 and Hall effect elements HT1–HT4 that detect the fluxes of the magnets MT1–MT4. The printer 6 determines based on the outputs (ON and OFF states) of the Hall effect elements HE1–HE4 whether an ID cartridge 7 loaded into the printer 6 is an appropriate one, and on the outputs (ON and OFF states) of the Hall effect elements HT1–HT4 whether a toner cartridge 3 attached to the ID cartridge 7 is an acceptable one.

Figure 12A:
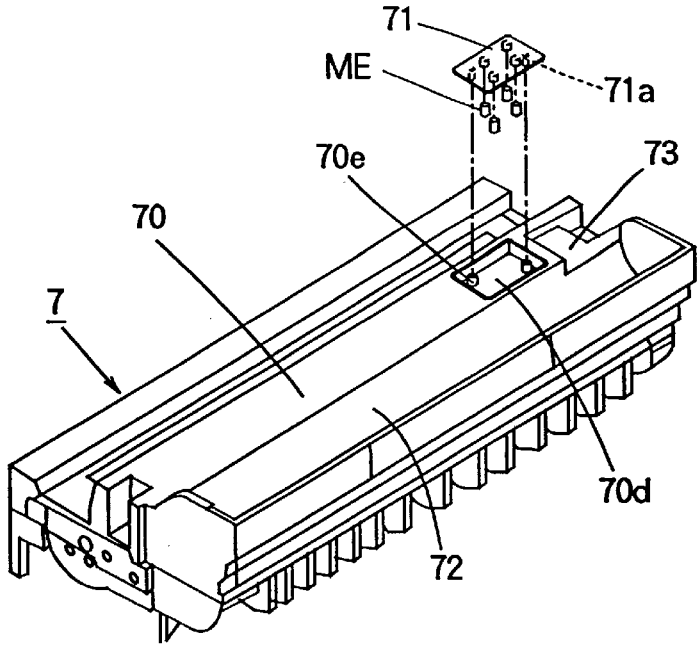
FIG. 12A is a perspective view of the ID cartridge 7 with a partial exploded view.

FIG. 12A is a perspective view of the ID cartridge 7 with a partial exploded view.

Figure 12B:
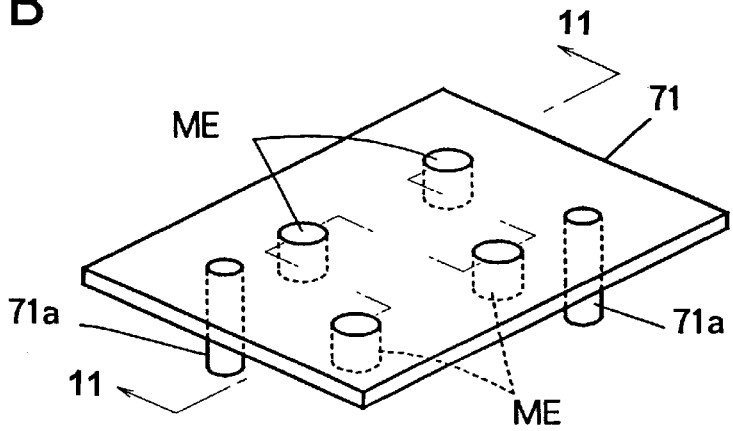
FIG. 12B is a perspective view of a magnet assembly 71.

FIG. 12B is a perspective view of a magnet assembly 71.

The ID cartridge 7 has an image drum (ID) mounted therein. As shown in FIG. 12A, the ID cartridge 7 includes a chassis 70, a magnet assembly 71, magnets ME1–ME4, a toner cartridge receiving section 72, and a lever receiving section 73. The toner cartridge receiving section 72 and lever receiving section 73 are of the same structure as the toner cartridge receiving section 52 and lever receiving section 53 of FIG. 4, respectively.

The chassis 70 is provided with a magnet receiving section 70*d*. The magnet assembly 71 is provided with magnet holders that receive magnets ME1–ME4 therein. The magnet assembly 71 is securely mounted to the bottom surface of the magnet receiving section 70*d* with projections 71*a* fitting into the receiving portions 70*e*. The magnet assembly 71 is provided with four magnets ME1–ME4 (FIG. 10B) so that a plurality of different types of the ID cartridge 7 can be expressed or identified. The magnet assembly 71 is of the same structure as the magnet assembly 31 of the first embodiment. The magnet assembly 71 and the chassis 70 are made of a non-magnetic material, for example, polystyrene.

The magnets ME1–ME4 are sandwiched between the magnet holders of the lid 2 and the bottom surface of the magnet receiving section 70*d*. Referring back to FIG. 10B, all of the four magnets are received in corresponding magnet holders by way of example. The arrangement and number of magnets can be selected according to the content or type of the ID cartridge 7. The magnets ME1–ME4 are mounted to the magnet assembly 71 in the same manner as the first and the second embodiments where the magnets M1–M4 are mounted to the magnet assembly 31 of the toner cartridge 3.

FIG. 11 is a partial cross-sectional side view of the printer 6 of FIG. 10A after the ID cartridge 7 and the toner cartridge 3 have been mounted and then the lid 2 has been closed. The hatched portion of FIG. 11 shows the cross sectional view taken along lines A—A of FIG. 12B.

As shown in FIGS. 10B and 11, the Hall effect element assembly 8 includes Hall effect elements HE1–HE4, Hall effect elements HT1–HT4, circuit board 80, board holder 81, and springs 82. The Hall effect elements HE1–HE4 and HT1–HT4 are aligned with the magnet holders MEH1–MEH4 of the ID cartridge 7 and magnet holders MTH1–MTH4 of the toner cartridge 3, respectively. The Hall effect elements HE1–HE4 and HT1–HT4 are mounted on the circuit board 80. The Hall effect elements HE1–HE4 and HT1–HT4 are the same as the Hall effect elements H1–H4 of the first embodiment. As shown in FIG. 11, the board receiving section 81a formed on the top of the board holder 81 receives the circuit board 80 therein, the Hall effect element side of the circuit board 80 facing down. The board holder 81 is suspended from the lid 2 by the springs 82.

The circuit board 80 has four Hall effect elements HE1–HE4 and four Hall effect elements HT1–HT4 mounted thereon. The Hall effect elements HE1–HE4 and HT1–HT4 correspond to the four magnet holders MEH and the four magnet holders MTH, respectively.

The Hall effect elements HE–HE4 are fixed at locations such that when the lid 2 is closed, the Hall effect element HEi (i=1, 2, 3, 4) faces the magnet MEi (i=1, 2, 3, 4). The gap G between the Hall effect element HEi and the magnet MEi is 2.6 mm. Likewise, just as in the first embodiment, the Hall effect elements HT1–HT4 are fixed at locations such that when the lid 2 is closed, the Hall effect element HTi (i=1, 2, 3, 4) faces the magnet MTi (i=1, 2, 3, 4). The gap G between the Hall effect element HTi and the magnet MTi is 2.6 mm.

Figure 12C:
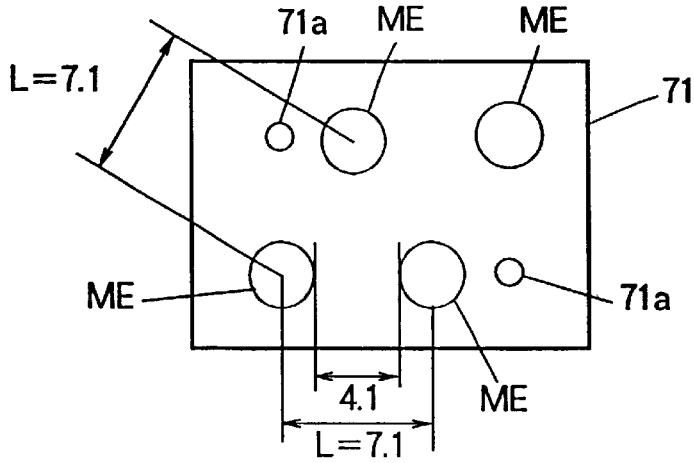
FIG. 12C illustrates the distance between adjacent Hall effect elements ME1–ME4.

FIG. 12C illustrates the distance between adjacent Hall effect elements ME1–ME4.

The diameter of the magnets is 3 mm and the center-to-center distance between adjacent magnets is 7.1 mm. Thus, the end-to-end distance between adjacent magnets is 4.1 mm. The center-to-center distance L between adjacent Hall effect elements HE mounted on the circuit board 80 is 7.1 mm. Likewise, the center-to-center distance L between adjacent Hall effect elements HT is also 7.1 mm. Therefore, the center-to-center distance L between adjacent magnet holders MEH and MTH is also 7.1 mm.

As shown in FIG. 11, when the lid 2 is closed, the bottom of the board holder 81 abuts the magnet assembly 71 mounted in the chassis 70 so that the magnet assembly 31 mounted in the rotary cap 30 is urged in a direction shown by arrow A by the springs 82. Just as in the first embodiment, the board holder 81 engages the lever 30*b* of the rotary cap 30 such that the rotary cap 30 is placed in position. When the lever 30*b* has been placed in position, the magnet assembly 71 and the magnet assembly 31 are of the same height. Then, when the lid 2 has been closed, the board holder 81 is urged by the springs 82 to abut the top surface of the magnet assemblies 71 and 31. Thus, the gaps between the Hall effect elements HE1–HE4 and magnets ME1–ME4 are the same as those between the Hall effect elements HT1–MT4 and the magnets MT1–MT4.

Figure 13:
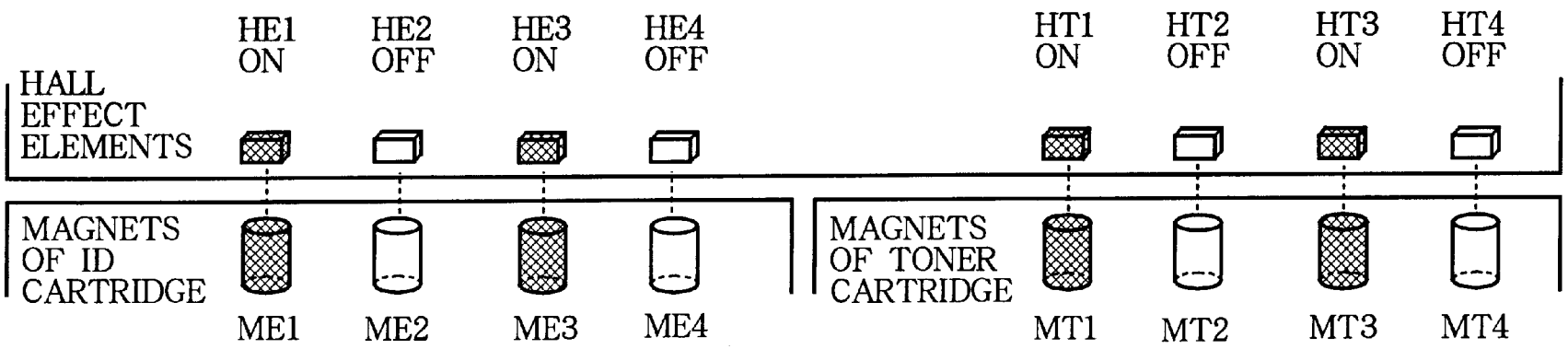
FIG. 13 illustrates, by way of example, the On and OFF states of the Hall effect elements and the presence and absence of the magnets.

FIG. 13 illustrates, by way of example, the On and OFF states of the Hall effect elements HE1–HE4 and HT1–HT4 and the presence and absence of the magnets ME1–ME4 and MT1–MT4. In Fig. the magnets ME1 and ME3 are present and therefore the Hall effect elements HE1 and E3 are ON. Likewise, the magnets MT1 and MT3 are present and therefore the Hall effect elements HT1 and HT4 are ON.

A cartridge-identifying operation for identifying a cartridge attached into the printer 6.

The cartridge-identifying operation is carried out when the lid 2 is closed and when the printer 6 is powered on. Therefore, every time the ID cartridge 7 or toner cartridge 3 is replaced, the cartridge-identifying operation is performed.

Figure 14:
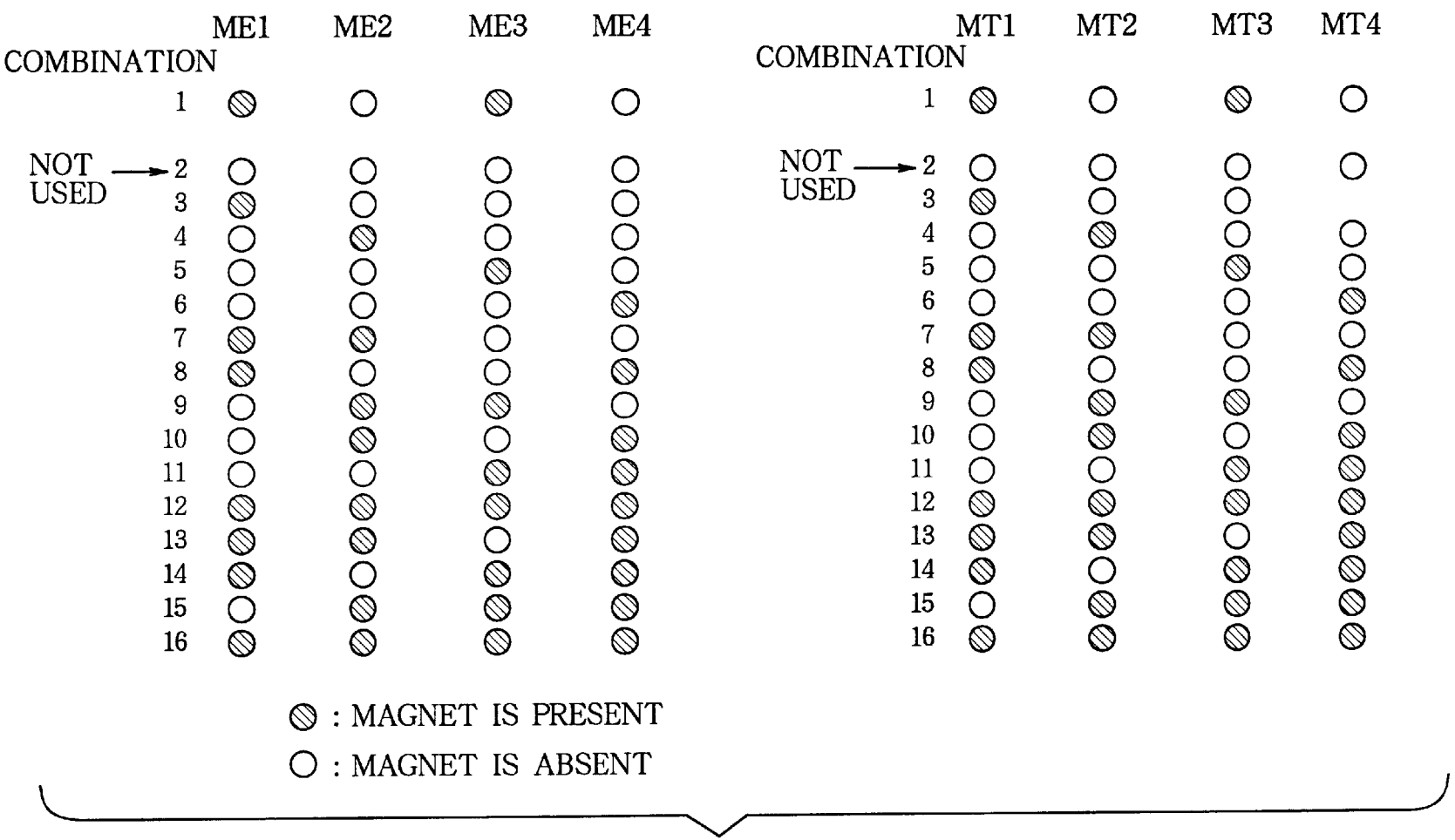
FIG. 14 illustrates possible combinations of the presence and absence of ME1–ME4 and MT1–MT4.

FIG. 14 illustrates possible combinations of the presence and absence of ME1–ME4 and MT1–MT4.

A total of sixteen different combinations can be made by combining the presence of the magnets ME1–ME4 in the magnet holders MEH1–MEH4 with the absence of magnets NE1–ME4 in the magnet holders MEH1–MEH4. An ID cartridge 7 having all magnet holders MEH1–MEH4 empty of magnets is not to be manufactured. Thus, according to the type or the content therein, 15 different ID cartridges 7 of the same appearance can be identified. Likewise, a total of sixteen different combinations can be made by combining the presence and absence of the magnets MT1–MT4 in the magnet holders MTH1–MTH4. A toner cartridge 3 having all magnet holders MTH1–MTH4 empty of magnets is not to be manufactured. Thus, according to the type or the content therein, 15 different toner cartridges 3 of the same appearance can be identified.

The printer 6 stores the magnet data for ID cartridge (i.e., combinations of the magnet holders in which magnets are present) and the magnet data for the toner cartridge (i.e., combinations of the magnet holders in which magnets are present). The printer 6 determines whether the stored magnet data for ID cartridge 7 matches with a combination of the ON and OFF states of the Hall effect elements HE1–HE4, thereby identifying the content of the ID cartridge 7 attached to the printer 6. The printer 6 also determines whether the magnet data for toner cartridge 3 matches with a combination of the ON and OFF states of the Hall effect elements HT1–HT4, thereby identifying the content of the toner cartridge 3 attached to the printer 6. If the printer 6 determines that the ID cartridge 7 or toner cartridge 3 is not an acceptable one, a display or voice message indicates to the operator that the inserted ID cartridge 7 or toner cartridge 3 is not acceptable, and the printer 6 stops.

Fourth Embodiment

<Construction>

Figure 15:
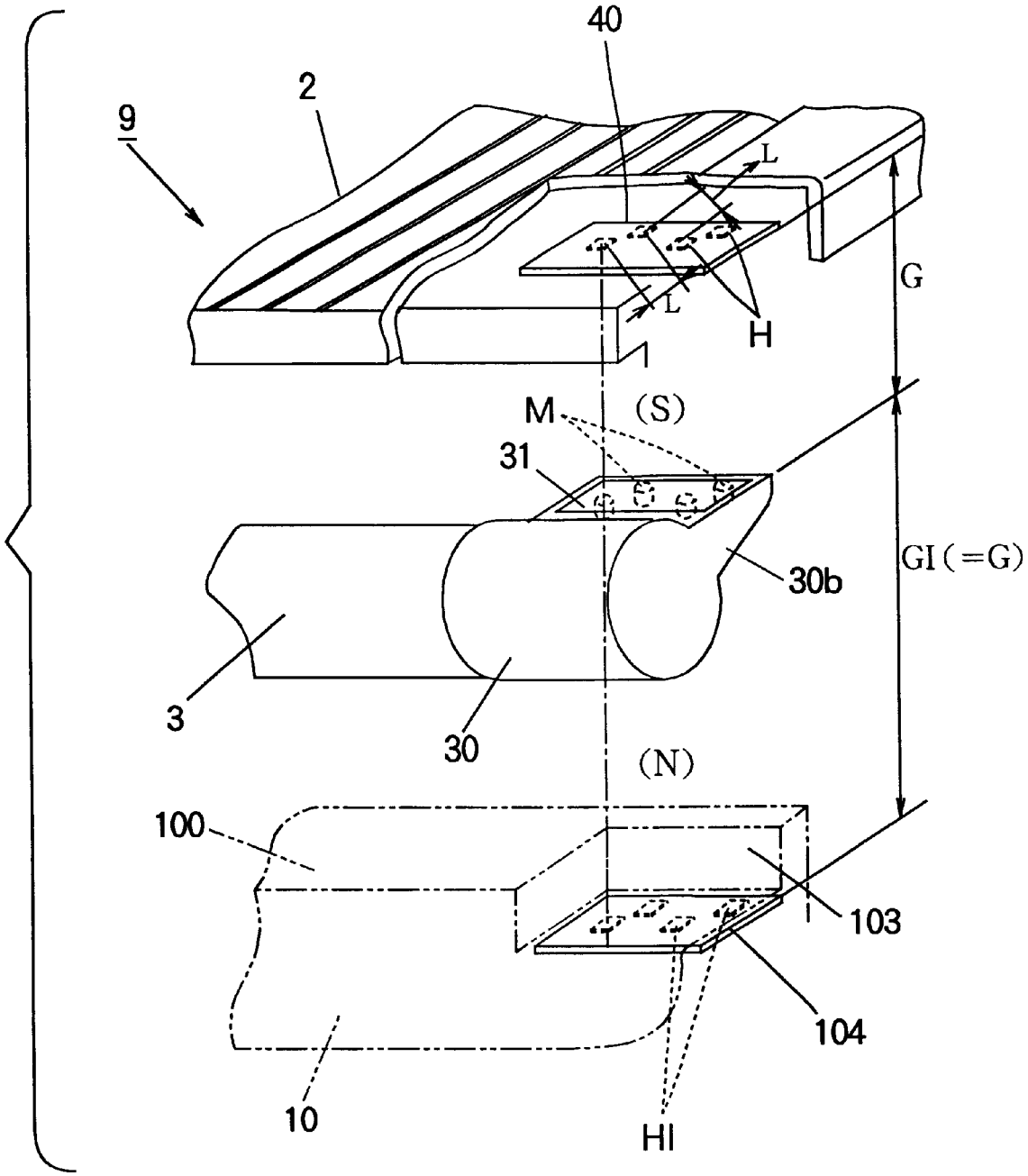
FIG. 15 is a partial exploded perspective view of a printer 9 according to a fourth embodiment.

FIG. 15 is a partial exploded perspective view of a printer 9 according to a fourth embodiment.

Figure 16:
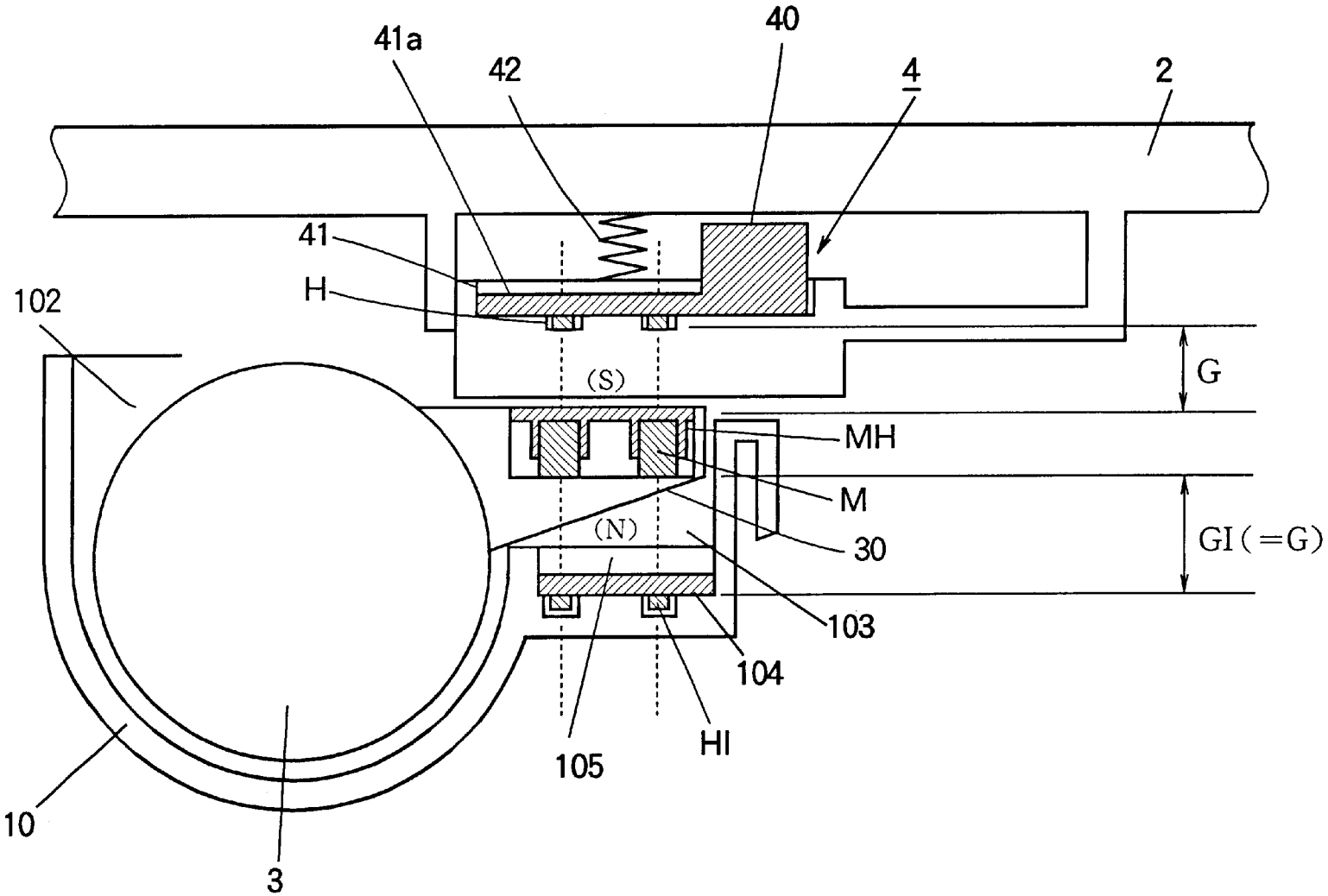
FIG. 16 is a partial cross-sectional view when the toner cartridge 3 and ID cartridge 10 have been attached to the printer 9 and the lid 2 has been closed.

FIG. 16 is a partial cross-sectional view when the toner cartridge 3 and ID cartridge 10 have been attached to the printer 9 and the lid 2 has been closed. Elements of FIGS. 15 and 16 similar to those of the first embodiment have been given the same references.

Referring to FIGS. 15 and 16, the ID cartridge 10 is equipped with Hall effect elements HI that detect the magnetic fluxes of the North poles of the magnets M. The Hall effect elements and magnets are arranged in the same manner as the first embodiment. The toner cartridge 3 has magnets M with the N poles oriented to the Hall effect elements HI and the S poles oriented to the lid 2. The lid 2 has Hall effect element assembly 4 incorporating Hall effect elements H that detect the fluxes of S poles of the magnets M. The Hall effect elements HI and H are of the same type. The printer 9 checks the ON and OFF states of the Hall effect elements H to determine whether the content of the toner cartridge 3 is acceptable. The printer 9 also checks the ON and OFF states of the Hall effect elements HI and H to determine whether the content of the ID cartridge 10 is acceptable.

The ID cartridge 10 includes a chassis 100, a toner cartridge receiving section 102, a lever receiving section 103, Hall effect elements HI, a circuit board 104 on which the Hall effect elements HI are mounted, and a circuit board receiving section 105 that accommodates the circuit board 104. The chassis 100 and toner cartridge receiving section 102 are of the same construction as the chassis 50 and toner cartridge receiving section 52 of FIG. 4.

The chassis 100 has the lever receiving section 103 at one end thereof. The lever receiving section 103 accommodates the lever 30*b* having magnets M mounted therein. The lever receiving section 103 has a circuit board receiving section 105 into which the circuit board 104 is fitted with Hall effect elements side facing down.

The circuit board 104 has four Hall effect elements HI1–HI4 each of which faces a corresponding one of four magnet holders of the lever 30*b*. The circuit board 40 has four Hall effect elements H1–H4 each of which faces a corresponding one of four magnet holders of the lever 30*b*. Thus, a Hall effect element HIi (i=1, 2, 3, and 4) faces the N-pole of a magnet Mi (i=1, 2, 3, and 4) held in a magnet holder MHi while the Hall effect element Hi faces the S-pole of the magnet Mi.

When the lid 2 has been closed, the Hall effect elements HIi of the ID cartridge 10 faces the magnet Mi such that the gap GI between the magnet Mi and the Hall effect elements HIi is 2.6 mm, i.e., the same as the gap G between the Hall effect elements Hi and the magnet Mi in the first embodiment. The center-to-center distance between adjacent Hall effect elements HI mounted on the circuit board 104 is 7.1 mm, i.e., the same as the center-to-center distance between adjacent magnet holders MH on the magnet assembly 31.

<Operation for identifying toner cartridge and ID cartridge>

The toner cartridge/ID cartridge identifying operation will now be described. This operation is activated when the printer 9 is powered up and when the lid 2 is closed. In other words, every time the ID cartridge 10 or the toner cartridge 3 is replaced, the operation is performed.

Just as in the first embodiment, the printer 9 determines whether the content of the toner cartridge 3 is acceptable one. That is, the printer 9 stores a predetermined item of "magnet data" therein and determines whether the magnet data matches with the combination of the ON and OFF states of the Hall effects H1–H4. If it is determined that the attached toner cartridge 3 is not accepted, then, a display or voice message indicates to the operator that the inserted toner cartridge 3 is not acceptable, and the printer 9 stops.

Then, the printer 9 determines whether the combination of the ON and OFF states of the Hall effect elements HI1–HI4 matches with the combination of the ON and OFF states of the Hall effect elements H1–H4. If they match with each other, then it is determined that the attached ID cartridge is an acceptable one. If they do not match with each other, then, a display or voice message indicates to the operator that the inserted ID cartridge is not acceptable, and the printer 9 stops. In the fourth embodiment, an ID cartridge having no Hall effects elements HI or having improper gaps GI between the Hall effect elements HI and the magnets M is determined as an unacceptable one.

The Hall effect elements H mounted on the lid 2 may be omitted, in which case, a check is made to determine whether a combination of the ON and OFF states of the Hall effect elements HI1–HI4 matches with the magnet data stored in the printer 9. If they match with each other, then it is determined that the contents or types of the toner cartridge 3 and the ID cartridge are acceptable.

Fifth Embodiment

A fifth embodiment differs from the first embodiment in that the magnets M mounted on the toner cartridge 3 are used to detect the opening and closing of the lid 2. The rest of the construction is the same as the first embodiment. In order to detect the opening and closing of the lid 2, a magnet M and a corresponding Hall effect element H are required. Conventional printers use a micro switch and a lever for driving the micro switch. This mechanical switch did not provide good detection accuracy.

In the fifth embodiment, if any one of the Hall effect elements H1–H4 is in the ON state, then the printer 1 determines that the lid 2 is closed. If all of the Hall effect elements H1–H4 are in the OFF state, then the printer 1 determines that the lid 2 is open, and the printer 9 stops.

While the first to fifth embodiments have been described with respect to the toner cartridge and the ID cartridge for a printer, the present invention may be applicable to ink cartridges and ink ribbon cartridges for facsimile machines and copying machines.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge for attachment to an image drum cartridge of an image forming apparatus having a magnetic sensor, the toner cartridge comprising:

a magnet assembly having at least one magnet disposed at a predetermined position, said predetermined position indicating a type of the toner cartridge;

wherein said at least one magnet is disposed at the predetermined position such that when the toner cartridge is attached to the image drum cartridge, said at least one magnet is detectable by the magnetic sensor by maintaining said magnet assembly uncovered by the image drum cartridge and other parts of the toner cartridge.

2. The toner cartridge according to claim 1, further comprising a lever in which said at least one magnet is arranged.

3. The toner cartridge according to claim 1, wherein said at least one magnet is arranged in a substantially flat plane.

4. The toner cartridge according to claim 1, further comprising a rotary cap, said magnet assembly being mounted on said rotary cap, said magnet assembly having said at least one magnet arranged thereon.

5. In combination, an image forming apparatus, and a toner cartridge receivable within said image forming apparatus, said toner cartridge comprising:

a magnet assembly having at least one magnet disposed at a predetermined position, said predetermined position indicating a type of the toner cartridge;

wherein said at least one magnet is disposed at the predetermined position such that when the toner cartridge is attached to an image drum cartridge of the image forming apparatus, said at least one magnet is detectable by a magnetic sensor of the image forming apparatus by maintaining said magnet assembly uncovered by the image drum cartridge and other parts of the toner cartridge; and said image forming apparatus comprising:

a magnetic sensor that generates a detection signal indicative of the position of the magnet; and a controller that determines a type of the toner cartridge on the basis of the detection signal.

6. The image forming apparatus according to claim 5, further comprising a Hall effect element assembly for determining the type of the toner cartridge.

7. The image forming apparatus according to claim 6, wherein the image forming apparatus includes a lid and the Hall effect assembly is mounted to the lid.

8. The image forming apparatus according to claim 7, wherein the Hall effect assembly comprises at least one Hall effect element positioned such that, when the lid is closed, the or each Hall effect element is in alignment with the or each corresponding magnet on the toner cartridge.

9. The image forming apparatus according to claim 5, wherein the magnet position and Hall effect assembly are configured to detect an opening and closing of the lid.

10. The image forming apparatus according to claim 5, further comprising an image drum cartridge.

11. The image forming apparatus according to claim 10, wherein the image drum cartridge includes at least one magnet disposed at a predetermined position.

12. The image forming apparatus according to claim 11, further comprising a Hall effect assembly for determining the type of the image drum cartridge.

13. The image forming apparatus according to claim 12, wherein the image forming apparatus includes a lid and the Hall effect assembly is mounted to the lid.

14. The image forming apparatus according to claim 13, wherein the Hall effect assembly comprises at least one Hall effect element positioned such that, when the lid is closed, the or each Hall effect element is in alignment with the or each corresponding magnet on the image drum cartridge.

* * * * *